United States Patent [19]

Moser

[11] 4,450,769

[45] May 29, 1984

[54] DUMMY AMMUNITION

[75] Inventor: Franz Moser, Fehraltdorf, Switzerland

[73] Assignee: Werkzeugmaschinenfabrik Oerlikon Bührle AG, Zurich, Switzerland

[21] Appl. No.: 383,817

[22] Filed: Jun. 1, 1982

[30] Foreign Application Priority Data

Jun. 24, 1982 [CH] Switzerland ..... 4173/81

[51] Int. Cl.[3] ..... F42B 5/22

[52] U.S. Cl. ..... 102/444; 102/529

[58] Field of Search ..... 102/501, 502, 529, 430, 102/444–447, 498

[56] References Cited

U.S. PATENT DOCUMENTS

| | | | |
|---|---|---|---|
| 1,256,255 | 2/1918 | Porter | 102/430 |
| 2,342,549 | 2/1944 | Le Gore et al. . | |
| 2,882,821 | 4/1959 | Benson . | |
| 3,027,840 | 4/1962 | Hannas et al. | 102/444 |
| 4,233,902 | 11/1980 | Hartley et al. . | |

FOREIGN PATENT DOCUMENTS

| | | |
|---|---|---|
| 2374614 | 12/1976 | France . |
| 572269 | 10/1945 | United Kingdom . |

*Primary Examiner*—Harold J. Tudor

*Attorney, Agent, or Firm*—Werner W. Kleeman

[57] ABSTRACT

A dummy cartridge or ammunition is disclosed comprising a cartridge case containing a case floor portion, a substantially cylindrical case wall, a substantially conical shoulder portion and a mouth portion. A dummy body member or projectile is inserted into the cartridge case and bears against the case floor portion. Means serve for securing one end of the dummy body member to the floor portion of the cartridge case, whereas a further portion of the dummy body member is attached to the mouth portion of said cartridge case. The dummy body member possesses a substantially cylindrical hollow compartment having a forward portion. An adjustable trim body is inserted into the forward portion of the hollow compartment, in order to place the center of gravity of the dummy cartridge at a predetermined desired position.

5 Claims, 1 Drawing Figure

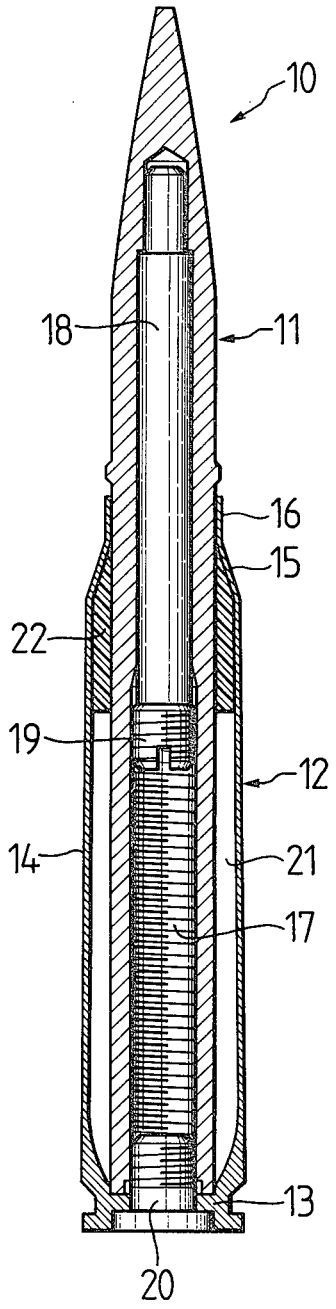
10
18
11
16
15
22
19
12
14
21
17
13
20

DUMMY AMMUNITION

BACKGROUND OF THE INVENTION

The present invention relates to a new and improved construction of dummy or drill ammunition and, more specifically, to a dummy cartridge which can be repeatedly used during practice firing of a weapon or the like.

Generally speaking, the dummy cartridge of the present development is of the type containing a cartridge case or sleeve which possesses a case floor or base, a substantially cylindrical wall, a case-conical shoulder portion and a case-mouth portion. Additionally, there is provided a dummy projectile body or projectile which bears upon the base or floor of the case and, on the one hand, is secured to the case base and, on the other hand, is attached to the mouth portion of the case.

According to a state-of-the-art dummy cartridge as disclosed in U.S. Pat. No. 2,882,821, granted Apr. 21, 1959, the center of gravity of the dummy cartridge is shifted, in relation to service or live cartridges, due to the attachment of the dummy projectile by means of a reinforcing rod at the base or floor of the cartridge case. However, this undesirably influences the infeed of the cartridges to or ramming of the cartridges into the weapon, since the dummy cartridges should desirably behave in the same manner as service ammunition.

Other constructions of ammunition or cartridges know to the art are exemplified, for instance, in French Pat. No. 2,374,614, filed Dec. 17, 1976, U.S. Pat. No. 2,342,549, granted Feb. 22, 1944, U. S. Pat. No. 4,233,902, granted Nov. 18, 1980, and British Pat. No. 572,269, granted Oct. 1, 1945.

SUMMARY OF THE INVENTION

It is a primary object of the present invention to provide a new and improved construction of dummy ammunition or cartridge which can be reliably and effectively repeatedly used during practice firing of a weapon.

Another and more specific object of the present invention aims at the provision of a new and improved construction of dummy cartridge which is resistent to the forces arising during the infeed or ramming of the dummy cartridge into a weapon, and which dummy cartridge is constructed such that the center of gravity is located at the proper place, even though the attachment of the dummy projectile or body at the case floor or base causes a shift in the center of gravity.

Still a further significant object of the present invention relates to an improved construction of dummy or practice cartridge which is designed such that it accurately simulates the firing of service or live ammunition, can be repeatedly used without danger of distortion or damage to the cartridge case, and can be reliably and economically fabricated.

Now in order to implement these and still further objects of the invention, which will become more readily apparent as the description proceeds, the dummy or practice cartridge of the present development is generally manifested by the features that, the dummy body or projectile possesses a substantially cylindrical hollow compartment or space. Contained in the front portion or region of the cylindrical hollow compartment or space is an adjustable threaded-in trim body, which serves to shift the center of gravity of the dummy cartridge to a desired location.

Through the provision of this trim or tunning body there is achieved the beneficial result that the dummy or practice cartridge behaves like service or live ammunition.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE of the drawing illustrates in longitudinal sectional view an exemplary embodiment of dummy or practice cartridge according to the invention.

DETAILED DESCRIPTON OF THE PREFERRED EMBODIMENTS

Describing now the single FIGURE of the drawing, there is disclosed therein a dummy or practice cartridge 10 containing a dummy body or projectile 11 and a cartridge case or sleeve 12. The cartridge case 12 possesses a case floor or base portion 13, a case wall 14, a case-conical shoulder portion 15 and a case-mouth portion 16. The conical portion or conical shoulder 15 of the cartridge case 12 has merging therewith the mouth portion 16 at the forward or free end of the cartridge case 12. The dummy body or projectile 11 possesses a substantially cylindrical hollow compartment or cavity 17 in which there is located a so-called trim or tuning body member 18. This trim or tuning body member 18 is retained by a first screw or threaded bolt 19 or equivalent structure at the forward portion of the hollow compartment 17. By means of a second threaded screw or bolt 20 or equivalent structure the dummy body or projectile 11 is attached at the floor or base 13 of the cartridge case 12. By means of the trim body or body member 18 there is achieved the desirable result that the center of gravity of the dummy cartridge 10 can be positioned at the same location where there is located the center of gravity of service or live cartridges or ammunition.

The inventive construction of dummy cartridge 10 furthermore advantageously possesses a casting mass or composition 22 which is located between the conical shoulder 15 of the cartridge case 12 and the dummy body or projectile 11. This casting means 22 serves to prevent any excessive distortion or upsetting of the cartridge case-conical shoulder portion 15. In this way the dummy or drill cartridge can be repeatedly used. If the cartridge case 12 of the dummy cartridge is deformed during the infeed thereof to a weapon and upon its ejection out of the weapon, particularly if the cartridge case-conical shoulder portion 15 is markedly deformed or stressed, then the dummy cartridge no longer can be used since there is no longer ensured for a reliable ramming into and ejection of the dummy or practice cartridge out of the firing weapon.

Due to the filling of the casting mass 22 between the conical shoulder portion 15 of the cartridge case 12 and the dummy body or projectile 11 there is not initially prevented any upsetting or deformation, but such is so small that the useful service life of the dummy cartridge is maintained. The casting mass 22 prevents that the deformation or upsetting of the cartridge case or casing 12 will exceed a certain value.

While there are shown and described present preferred embodiments of the invention, it is to be distinctly understood that the invention is not limited thereto, but may be otherwise variously embodied and practiced within the scope of the following claims. Accordingly,

I claim:

1. A dummy cartride comprising:

a cartridge case containing a case floor portion, a substantially cylindrical case wall, a substantially conical shoulder portion and a mouth portion;

a dummy body member inserted into the cartridge case and bearing against the case floor portion;

said dummy body member having opposed ends;

means for securing one end of said dummy body member to said floor portion of said cartridge case;

a further portion of said dummy body member being attached to said mouth portion of said cartridge case;

said dummy body member possessing a substantially cylindrical axially directed hollow compartment which is open towards said case floor portion; and an axially displaceable trim body inserted into said hollow compartment, in order to axially displace the position of the center of gravity of the dummy cartridge while maintaining its weight.

2. The dummy cartridge as defined in claim 1, wherein:

said adjustable trim body is threadably inserted into the forward portion of the cylindrical hollow compartment of said dummy body member.

3. The dummy cartridge as defined in claim 1, wherein:

said further portion of said dummy body member is attached to said mouth portion of said cartridge case by clamping said dummy body member at said mouth portion.

4. The dummy cartridge as defined in claim 1, further including:

a casting mass arranged between said dummy body member and the conical shoulder portion of said cartridge case.

5. A dummy cartridge comprising:

a cartridge case containing a case floor portion, a substantially cylindrical case wall, a substantially conical shoulder portion and a mouth portion;

a dummy body member inserted into the cartridge case;

said dummy body member being secured to said case floor portion and to said mouth portion;

said dummy body member possessing a substantially cylindrical hollow compartment;

said hollow compartment defining a rear end which is open towards said case floor portion, and a forward portion;

an axially displaceable trim body threadably inserted into said forward portion of said hollow compartment, in order to place the center of gravity of the dummy cartridge at a predetermined desired position; and a casting mass arranged between said dummy body member and the conical shoulder portion of said cartridge case.

* * * * *